United States Patent [19]

Prusman

[11] Patent Number: 4,729,750

[45] Date of Patent: Mar. 8, 1988

[54] FLYING TOY CONTROLLABLE IN THREE DIMENSIONS

[76] Inventor: David Prusman, 138 Walgrove Ave., Dobbs Ferry, N.Y. 10522

[21] Appl. No.: 830,545

[22] Filed: Feb. 18, 1986

[51] Int. Cl.[4] ..... A63H 27/10

[52] U.S. Cl. ..... 446/225

[58] Field of Search ..... 446/220, 225, 36, 37

[56] References Cited

U.S. PATENT DOCUMENTS

| | | | |
|---|---|---|---|
| 916,605 | 3/1909 | Rouse . | |
| 949,420 | 2/1910 | Engisch . | |
| 1,397,135 | 11/1921 | Malouf . | |
| 1,827,775 | 10/1931 | Berger . | |
| 1,994,202 | 3/1935 | Sarsfield . | |
| 2,219,658 | 10/1940 | Pasek . | |
| 2,364,427 | 9/1943 | Davidson . | |
| 2,701,935 | 2/1955 | Florence . | |
| 2,783,584 | 3/1957 | Venturella . | |
| 3,292,304 | 12/1966 | Wolfe | 446/225 |
| 3,762,702 | 10/1973 | Keele et al. . | |
| 4,161,843 | 7/1979 | Hui | 446/37 |
| 4,204,656 | 5/1980 | Seward, III . | |

FOREIGN PATENT DOCUMENTS

| | | | |
|---|---|---|---|
| 2460517 | 1/1981 | France | 446/220 |

*Primary Examiner*—Philip C. Kannan

*Attorney, Agent, or Firm*—Schweitzer & Cornman

[57] ABSTRACT

A flying toy controllable in three dimensions. A gas inflatable envelope preferably a helium filled balloon is secured to a remote controlled first motor with a normally vertical output shaft having a first propeller. The output shaft is tiltable such that it assumes a plurality of angular positions in a vertical plane. A second remote controlled motor with output shaft and associated propeller is also secured to the balloon and when activated rotates the toy about its vertical axis. The two motors and the mechanism for tilting the output shaft of the first motor provide a flying toy controllable in three dimensions. Substantially, all of the buoyancy of the balloon is provided by the lighter-than-air gas of the balloon.

9 Claims, 3 Drawing Figures

FIG. 1
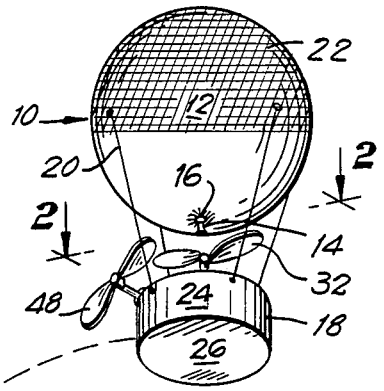
FIG. 2
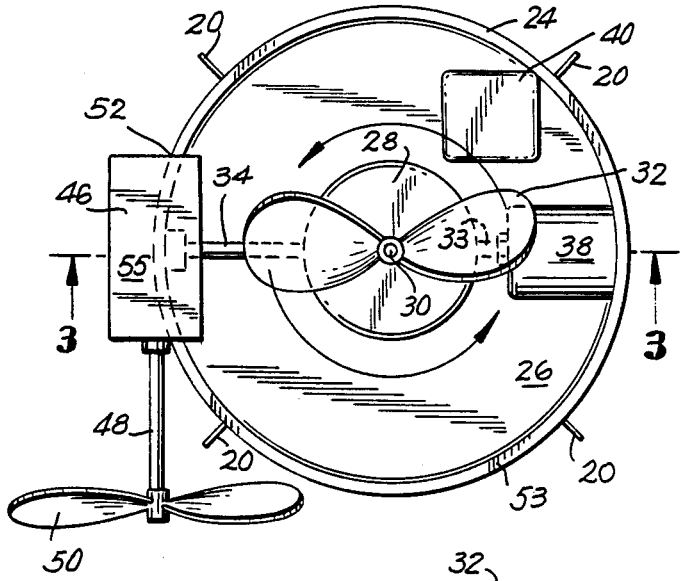
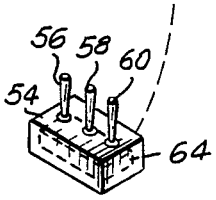
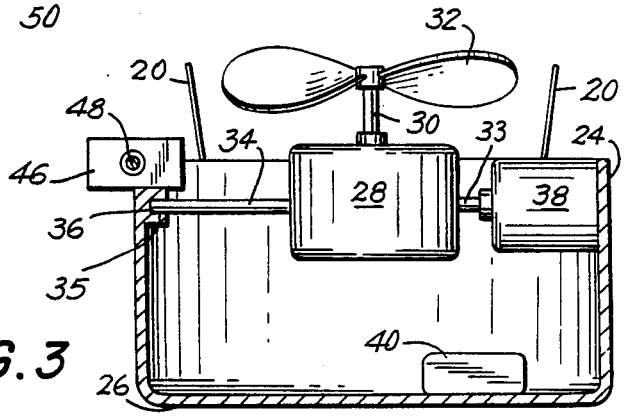
FIG. 3

FLYING TOY CONTROLLABLE IN THREE DIMENSIONS

BACKGROUND OF THE INVENTION

The present invention relates to a flying toy controllable in three dimensions. More specifically, the present invention, in the preferred embodiment, visually resembles a model hot air balloon, having a helium filled balloon with a suspended basket located beneath, which toy is controllable, in three dimensions. In the preferred embodiment, the toy is controlled by remote control.

Flying toys have a particular appeal, not just to youngsters, but in addition to adults. This type of toy appeals especially to hobbyists who appreciate the sense of freedom in flying. In this connection, a toy which combines the apparent freedom provided by floating on air currents, away from machinery, that a hot air balloon provides and, in addition, is fully controllable in all three dimensions, is a highly desirable toy. Toys capable of flying have been provided in the past. More specifically, model airplanes which are driven by a single gasoline engine and a propeller have been made which, too, are remote controlled in three dimensions. These toy airplanes, however, are not to be used indoors, are noisy and do not appear to float on air currents, in touch with nature, without aid of machinery. Gliding airplanes are also a form of a flying toy, yet they can't be controlled. The present invention relates to a flying toy, controllable in three dimensions, which appears to "float in the air". Thus, it combines the free floating desireable feature of a hot air type balloon with the controllability in three dimensions of a plane, yet capable of being played with indoors. Much of the floating or air buoyancy of the toy is provided by the toy having an envelope, a balloon, filled with a lighter-than-air gas, e.g., helium.

DESCRIPTION OF THE PRIOR ART

Model or toy airplanes having gasoline powered engines are available to the toy hobbyist. These airplanes are provided with ailerons and a rear rudder, all of which contribute to controlling, by remote control, the plane. These type of airplanes, however, suffer from several disadvantages, among them being the danger associated with using gasoline, the uncontrollability of the airplane, the large associated noise, and especially the inability to use the airplane in a small room. By and large, these toy model airplanes are for exclusive outdoor use. Since forward speed is required to lift the plane and keep it airborne, the plane requires large areas for use. Accordingly, it is a specific object of the present invention to provide a flying toy, easily and accurately controllable in three dimensions, which can be used indoors or, alternatively, outdoors. The toy of the present invention "floats" in a room, if desired, and is more quiet than the gasoline engine airplane.

Airplane gliders, made from lightweight, balsa wood, are also available at toy and hobby stores. These devices, however, suffer from the inherent disadvantage in that they are not precisely controllable but merely ride wind currents. It is a specific object of the present invention to provide a flying toy which is easily controllable in all three dimensions and which can stay airborne for relative long periods of time. This cannot be done with a glider unless it is launched from a mountain ledge or skyscraper.

Flying toys have also been sold where the airplane, helicopter, etc. "flies" while being supported by a centrally located pylon or post. The height that the plane can attain and its speed around the post can be controlled, within limits. These toys, however, do not have true three-dimensional freedom in that they are constantly tethered to the center post. It is a specific object of the present invention to provide a flying toy, controllable in three dimensions, which is not mechanically constrained by being attached to a central post or pylon.

The present invention provides, in the preferred embodiment, a flying toy in the form of a hot air balloon, on a reduced scale. Thus, the toy is apparently dependent upon nature's forces of wind and gravity. This is a desirable object in much the same way that "purists" feel that sailboats are closer to nature than power boats. Since much of the buoyancy of the toy is provided by a lighter-than-air balloon, minimizing sized motors are all that is required to raise the toy and control its movement, in all directions. In addition, however, the flying toy of the present invention is fully controllable, in three dimensions, preferably by remote control and this aspect, too, contributes to the user's sense of true flying.

U.S. Pat. No. 2,783,584 relates to an airplane toy balloon having a first horizontal helicopter-type propeller used in conjunction with a second angularly oriented airplane-type propeller, all secured beneath an inflatable helium filled toy balloon. The devices disclosed by this patent, however, is not truly controllable by the user in three dimensions in contrast to the invention disclosed herein. More specifically, the present invention contemplates that the propellers of the flying toy be positively driven by electrical motors to provide positive, controlled thrust in desired directions, whereas the helicopter-type propeller and the airplane-type propeller of the referred-to patent are not positively nor controllably driven but, rather, they rotate, if at all, by wind turbulence.

Furthermore, the angular adjustability of the lower airplane-type propeller, of the U.S. Pat. No. 2,783,584 with respect to the horizontal helicopter-type propeller is fixed during flight (see FIG. 5 showing the fixing of the lower airplane propeller support rod with respect to the upper helicopter support rod). In this manner, the upward angle of ascension of the flying toy is first fixed for a flight, and cannot, therefore, be varied during flight. This, too, is in direct contrast to the device of the present invention which contemplates that the plane of rotation of the normally horizontal propeller, providing upward thrust, be adjustable during flight, by remote control, so as to provide a component of toy movement in a lateral direction. The present toy constantly controls the angle and direction of ascension of the toy.

The use in the U.S. Pat. No. 2,783,584 of two fixed orientation propellers, determined before flight even assuming the propellers were driven by motors, nevertheless, only gives that device controlled mobility along a line or at most, mobility in two dimensions, whereas the present invention, more fully explained hereinafter, by using a second small propeller for rotation of the flying toy about a vertical longitudinal axis, provides the flying toy with true three dimensional controlled mobility.

U.S. Pat. No. 949,420 relates to an inflatable toy airship. This reference teaches a front propeller d (see FIG. 2) which is driven by a rubber band g. A rear rudder i and horizontal planes n control the angle of ascension and the side-to-side direction of the toy airship when the rubber band is twisted and airship and band released. However, as stated in the specification of the U.S. Pat. No. 949,420 the horizontal planes n and the rear rudder i are adjusted, before the flight, and maintained in position during the flight by the frictional forces acting on those elements. Thus, this reference does not teach in-flight directional adjustability. Also, the airship will not remain airborne for very long, in that the airship will fall to the ground as soon as the rubber band unwinds. Sustained flights, controlled in three dimensions, will not be achieved by the device of the U.S. Pat. No. 949,420.

U.S. Pat. No. 2,701,935 relates to a helium filled toy balloon carrying a gondola or basket which, upon string 52 (see FIG. 2) being pulled downwardly, releases toy figurine parachute jumpers with fabric-type parachutes. This patent shows a helium filled toy balloon carrying a basket but is not controllable in any dimension, with the exception of a tether line to pull the toy down, after use.

U.S. Pat. No. 1,994,202 relates to an aerial toy and shows a helium filled balloon which is provided, at its ends, with suction cup devices which rotatably secure a pair of air-driven pinwheels. Thus, the pinwheels are not positively driven but, rather, are intended to rotate by normally occurring wind currents. There is no means for controlling, in three dimensions, the aerial toy disclosed in this patent, nor is provision made for sustained rotator of the driving propellers.

U.S. Pat. No. 2,364,427 relates to a toy airplane which is suspended in the air by a balloon filled with lighter-than-air gas. The propeller of this plane is not positively driven and no mechanism is provided for controlling, in three dimensions, the mobility of this device. Simply put, it is a helium balloon for suspending an airplane-like device.

U.S. Pat. No. 916,605 relates to a toy balloon and, specifically, shows a gas receptacle A providing buoyant suspension for a lower suspended "car" D. A propeller F is mounted on a shaft or pin G which is secured to the car D. This patent neither teaches nor suggests the use of a positively driven propeller, nor does it teach controlling, in three dimensions, a flying toy. It does show providing buoyant support to a suspended-below vehicle, having a single non-driven propeller, by a balloon filled with lighter-than-air gas.

U.S. Pat. No. 3,762,702 teaches a remote controlled tethered toy having a pair of individually rotatable suspended arms, on the ends of each of which is attached an airplane-like toy. Each airplane is suspended from its own separately controllable suspension arm. This device, however, does not provide full control over the mobility of the airplane since its position is limited by the support arms and the attached wires.

U.S. Pat. No. 1,827,775 teaches an airplane-like toy suspended at one end of a rod, with the other end suspending a blimp-like device (see FIG. 6). The airplane's propeller is driven by a spring (see FIG. 5). This device, when operated, is intended to have the airplane and blimp traveling in a horizontal circle (see the dotted lines of FIG. 1). Here, again, there is no teaching of true three dimensional control of the position of the plane.

U.S. Pat. No. 2,219,658 relates to a toy airplane which is supported by a rod 18 which is pivotable about upwardly projecting pivot pin 14. Both the speed of rotation about shaft 14 and, in addition, the height of the airplane above the runway, can be controlled by a pair of joysticks 30 and 36. This reference also does not teach the objectives sought to be accomplished by the present invention.

U.S. Pat. No. 1,397,135 shows a toy airplane driven by an electric motor housed in the fuselage and driving a propeller 19, which airplane, however, can only travel horizontally on a predetermined trolley path.

SUMMARY OF THE INVENTION

The present invention relates to a flying toy capable of being controlled in three dimensions. The flying toy of the present invention can be used either outdoors or indoors, if desired. In the preferred embodiment of the present invention, the flying toy takes the form of a hot air model balloon, i.e., a balloon filled with a lighter-than-air gas and having a suspended basket or gondola located beneath the balloon. Providing substantially all of the buoyancy to enable the flying toy to be raised off of the ground is an envelope, preferably a balloon, filled with the lighter-than-air gas. The gondola or basket is suspended from the gas filled envelope and provides housing for thrusters to controllably move the toy, in the preferred embodiment, comprising remote controlled electric motors driving propellers which, when suitably manually controlled and powered, allow the flying toy to have unlimited mobility and to be controlled in three dimensions.

The volume of the balloon filled with lighter-than-air gas is adjusted such that the toy, with all motors "off" will rest on the ground, yet the balloon provides substantially all of the toy's buoyancy. Thus, with the motor "off" an equilibrium is achieved between the buoyancy provided by the filled balloon and the weight of the toy. According to the preferred embodiment of the invention, a first electric motor, a vertical thrust provider, having an output shaft in a first position, vertical with respect to the floor of the suspended basket, is provided with a propeller rotatable in a horizontal plane. Rotation of the output shaft, by driving the electric motor, causes the flying toy to be raised off of the ground or support surface. The first electric motor having an output shaft carrying the first propeller is, itself, in the preferred embodiment, angularly adjustable, in a vertical plane, so that a lateral component of toy movement can be achieved by remote control of the angular position of the output shaft having the attached propeller.

Also secured to the gondola or basket is a second thrust providing mechanism, in the preferred embodiment a remote controlled electric motor having an output shaft and propeller attahced thereto which, in combination with the first propeller, provides the flying toy with three dimensional mobility.

The first propeller, providing a component of flying toy movement in both the vertical and a first lateral direction if, by itself, would provide the flying toy with two-dimensional mobility along a line in a vertical plane. Having the angular adjustment of the output shaft of the first motor infinitely variable, in a vertical plane, provides unlimited two dimensional mobility in that same vertical plane. The addition of a second electric motor driving an output shaft with a propeller located thereon, with the second motor's output shaft preferably perpendicular to the normally vertical output shaft of the first motor, thereby causing the second propeller to be driven in a plane of propeller rotation which is vertical, provides the flying toy with true, three dimensional mobility. The second motor causes the toy to rotate about its vertical axis and therefore the single vertical plane for toy movement then becomes three dimensional space for toy movement.

In the preferred embodiment of the present invention, the mechanism for angularly adjusting angular orientation of the output shaft of the main motor or vertical thrust mechanism is a remote controlled motor. The output shaft of this electric motor is driven at low relative rpm's and is connected to the first electric motor to thereby swivel the first motor, with attached propeller, about the horizontal output shaft of the tilt providing electric motor. Thus, the output shaft of the main or first motor is angularly adjustable in a vertical plane.

The actual control of the flying toy is, preferably, accomplished by a control box which includes three joysticks. The first joystick is intended to control the speed of the main upward thrust mechanism, in the preferred embodiment, the first electric motor with output shaft and attached propeller. This joystick will, unless positively deflected, provide a motor shut-off. The second joystick control is intended to control the first output shaft's angular tilt. The electric motor which is provided for selectively tilting the angle of ascension of the flying toy is controlled by the second joystick. When the second joystick is deflected forwardly, it causes the output shaft of the main motor and main propeller to tilt in one direction, as desired. When the joystick is pulled backwardly, it causes the output shaft of the main motor to tilt in the other direction. It should be appreciated that differing amounts of deflection of the joystick from its normal vertical position precisely correlates to the angle of tilt provided to the main output shaft. If the second joystick is neither deflected forwardly nor backwardly, then the joystick will assume a vertical position with the output shaft of the main motor in a vertical position and the plane of rotation of the first propeller then being horizontal. The third joystick control is adapted for selective control of yet another electric motor, having its own output shaft with a propeller thereon. The third joystick's "Off" position provides no rotational speed to the output shaft and, hence, no rotation of the attached propeller. The propeller, when caused to rotate by its electric motor, is adapted for rotation in a vertical plane. Deflecting the third joystick in a first direction causes the second propeller to rotate in a first direction of rotation in the vertical plane; with increasing deflection of the third joystick, resulting in increased rotational speed of the propeller. Deflecting the joystick in the other direction causes the second propeller to rotate in a second direction of rotation in the same vertical plane and, again, increasing deflection results in increased speed of rotation. Thus, it is desirable that the toy rotating motor be a reversible variable speed motor, although a unidirectional constant speed motor would also accomplish the desired function; it would, however, take a longer time to achieve the desired turning amount of the toy.

It is also an aspect of the present invention that a magnet be provided to the base of the flying toy for selective picking-up of toy cargo made of metal. In the preferred embodiment, the cargo picking-up mechanism is an electromagnet, with a remote controlled switch, such that the picking-up means can selectively pick up and drop the toy cargo, when desired.

It is also an aspect of the present invention that substantially all of the buoyancy required for raising the flying toy off the ground is provided by the envelope filled with lighter-than-air gas. In this manner, the size of the motors and propellers needed to surmount gravity and control the toy are kept small and the flying toy will appear to be a replica of a hot air balloon, apparently independent of mechanical means for operation. An adjustable ballast for achieving substantial equilibrium is thus desirable, such that the buoyancy provided by the inflated balloon is basically counter-balanced by the weight of the toy with the toy, in its "Off" position just resting on the ground and such that activating the main electric motor, providing a component of vertical thrust, will easily and responsively raise the toy off the ground.

BRIEF DESCRIPTION OF THE DRAWINGS

FIG. 1 is a perspective view of the controllable flying toy, in its preferred, remote controlled embodiment (hard wiring between the flying balloon and basket and the control box being shown in phantom);

FIG. 2 is a cross sectional view of the flying balloon and basket, taken along lines 2—2 of FIG. 1; and FIG. 3 is a cross sectional view taken along lines 3—3 of FIG. 2.

DETAILED DESCRIPTION OF THE DRAWINGS

As best seen in FIG. 1, the flying toy, controllable in three dimensions, in the preferred embodiment, comprises an inflatable balloon, made of rubber, which should be filled with a lighter-than-air gas, preferably helium. It should be appreciated that while the present invention is disclosed in connection with a helium-filled, round, toy balloon, the invention could assume a plurality of other physical forms, as long as a gas inflatable envelope is provided. The flying or airborne component of the flying toy, generally referred to by numeral 10, comprises an inflatable envelope or round balloon 12. The balloon, as mentioned, is inflated with a lighter-than-air gas, preferably helium, and the orifice 14 of the balloon 12 is sealed or closed off by knotting the orifice or by a string or other valve closing means 16. A basket or gondola 18 is suspended downwardly from the balloon 12 by a plurality of strings 20 which are tied, on their lower ends to the gondola 18 and on their other ends they are tied to a netting 22. The netting 22 covers a portion of the top of the balloon 12 and enables the basket or gondola 18 to be suspended beneath the balloon 12. The netting 22 also facilitates replacement of the balloon 12 when it has partially deflated over a period of time.

The basket or gondola 18 is circular and consists of a circumferential wall 24 and a circular floor 26. The strings 20, serving to connect or suspend the basket or gondola 18 beneath the balloon 12, pass through circumferential wall 24 and are secured to the basket by tying knots in the ends of the strings, with the other ends of the strings tied to the netting 22.

A first electric motor 28 is housed in gondola 18 and has an output shaft 30 on which propeller 32 is non-rotatably secured, such that when power is provided to motor 28, output shaft 30 and propeller 32 rotate. In the preferred embodiment of the present invention, electric motor 28 has an adjustable speed of revolution for output shaft 30 and propeller 32. A second motor 38, secured to the circumferential wall 24 of basket 18 has an output shaft 33. A rotatable support axle 34 is either integral with output shaft 33, i.e., it is merely an extension of the shaft or the support axle is a separate shaft coaxially secured to the output shaft. Support axle 34 is non-rotatably secured to electric motor 28. This support axle 34 can either be a single axle passing through the housing of motor 28 or, alternatively, can be split such that a first portion of the axle is connected to the side of the housing of motor 28 near to motor 38 with a second portion of the axle connected to the other side of the housing of the motor 28. The free end 35 of support axle 34 is rotatably secured in a recessed opening providing a bearing point, located in circumferential wall 24 of gondola or basket 18. The other end of axle 34 is, as mentioned, either integral with output shaft 33 or connected to the output shaft 33 of second electric motor 38. Second electric motor 38 is secured to the circumferential wall 24 at a position diametrically opposed to recessed opening 36. This second electric motor 38, when driven, causes the support axle 34 to slowly rotate and thereby tilt motor 28. This allows output shaft 30 of first motor 28 to assume an infinite variety of angular orientations with respect to the bottom 26 of the basket 18. Thus, various angles of ascension are possible by activating second motor 38. The output speed of second electric motor 38 is not necessarily adjustable and can, in fact, be a fixed speed motor with a speed of rotation far less than the rotational output speed of first electric motor 28.

It will be appreciated, when viewing the drawings, that the output shaft 30 of first motor 28 is normally located directly above the center of the basket or gondola. When, however, electric motor 38 is powered, the first motor 28 with its output shaft 30 and propeller 32 will tilt, such that output shaft 30 extends at an angle to the central vertical axis of the flying toy. In this position, when motor 28 is also activated to turn propeller 32, components of thrust are created, both in the upward lifting direction and, in addition, in a lateral direction. The output shaft 30 with propeller 32 of motor 28 is thus capable of assuming a plurality of angular positions, providing a plurality of ascension angles, with respect to the floor 26 of the gondola or basket 18, all of the positions of the output shaft 30 lying in a vertical plane, perpendicular to the floor 26. In this manner, an infinite number of rotational planes for the first propeller is provided.

Also housed in gondola or basket 18 is a third electric motor 46, having an output shaft 48 and a propeller 50 non-rotatably secured to output shaft 48. According to the preferred embodiment of the present invention, the output shaft 48 of the third motor 46 is tangential to circumferential wall 24 of the basket or gondola 18. Output shaft 48 of third electric motor 46 is perpendicular to output shaft 30 of first motor 28, when electric motor 38 is not activated, i.e., when output shaft 30 is in its normal, true vertical position output shaft 48 is perpendicular thereto. The third electric motor 46 is held in a cutout 52 of circumferential wall 24, such that the entire height of the motor does not extend above the top edge 53 of circumferential wall, yet the top 55 of the third motor 46 is slightly above top wall 53. Activation of third electric motor 46 causes propeller 50 to rotate in a vertical plane of rotation. If first electric motor 28 is either "off" or if activated, with output shaft 30 vertical (electrical motor 38 in its "off" mode), activation of third electric motor 46 will cause the flying toy to spin or rotate around an imaginary line passing through vertical output shaft 30.

In the preferred embodiment of the present invention, a battery pack 40 consisting of a plurality of commercially available batteries is provided within the interior of the gondola or basket 18. Battery pack 40 is electrically connected by suitable wiring to motor 28, motor 38 and motor 46. Also, in the preferred embodiment of the present invention, it should be appreciated that motor 28, motor 38 and motor 46 are remotely controlled (not hand wired) by external controls which, in the preferred embodiment, comprises a set of three joysticks, housed in a control box 54. The electrical wiring between battery pack 40 and the three motors located within the gondola or basket 18 is not shown in the drawings for clarity of illustration of the other elements but it will be appreciated that it is a simple matter to properly wire the motors to the battery pack. If the device is remotely controlled, the control box is provided with three channels of radio frequency for transmission and the electric motors with appropriate receivers of those signals.

The control box 54 consists of a first joystick 56, a second joystick 58 and a third joystick 60. Deflection of the joysticks, forwardly and rearwardly, from their normal vertical position selectively controls the operation of motor 28, motor 38 and motor 46, respectively, in a manner described hereinafter. The joysticks can be provided with automatic "returns" such that unless manually deflected the joysticks assume a vertical position, corresponding to a desired position or mode of operation of the associated electric motor.

In an alternate embodiment of the present invention, in order to minimize the weight of the toy and, therefore, decrease the size of the required inflated balloon, the flying toy can be hard wired by wires 62 (shown in phantom) to the control box 54, with the batteries required to power the motor then housed within the control box 54, as shown in phantom outline by battery pack 64. If this embodiment of the present invention is used, battery pack 40 is eliminated. Wires 62 comprise at least four electrical strands which serve to electrically connect control box 54 and the motors 28, 38 and 46. Four strands of electrical wiring need only be used by connecting single strands to each of the motors 28, 38 and 46 and by using a single common return wire for all three motors. Of course, a six strand wire could also be used (each motor having its own pair of wires) but, for weight minimizing purposes, a four strand wire is preferred.

It should be appreciated that electric motors 28 and 38 which are preferably remote controlled, can be the very same remote controlled motors now used in toy car vehicles available in toy stores. The vehicle driving motor, providing drive for the rear wheels of the car can be used as first motor 28, with the second steering wheels-turning motor of the toy car, which, when activated, slowly turns the front steering wheels, being used as second electric motor 38 for selectively tilting motor 28. The third electric motor 46 can be a duplicate of the rear wheel driving motor used in the available toy cars.

Another feature of the present invention is the provision of a magnet 66 (not illustrated) secured to the outside of the basket or gondola 18. This magnet can selectively be used to pick up magnetic toy cargo when the flying toy is controlled such that the magnet comes into contact wtih the cargo. The magnet 66 can be an electromagnet with a separate control, powered by the batteries, such that the flying toy can be used to pick up and then selectively drop the cargo where and when desired.

In operation, according to the preferred embodiment, wherein remote controls are used, the operator holds control box 54 with joysticks 56, 58 and 60. For the purposes of describing the operation of the invention, it is assumed that joystick 56 controls motor 28 and thus output shaft 30, with propeller 32 secured thereto. Joystick 58 controls electric motor 58, such that movement of the joystick 58 from its normal first position will cause motor 28, output shaft 30 and propeller 32 to tilt by rotation of axle 34. Finally, for the purposes of describing the operation of the invention, joystick 60 controls motor 46 and thus rotation of output shaft 48 having propeller 50 non-rotatably secured thereto. It should also be appreciated that all three controls, i.e., joysticks, are provided with a first "Off" position with the joystick perpendicular to the top surface of control box 54 and at least one additional position for rotating the output shafts of the respective motors.

Prior to flight, the balloon 12 must be filled with helium and the gondola or basket 18 suspended beneath it by slipping netting 22 over the balloon. The amount of inflation is initially more than enough to raise the balloon without the aid of the motors. Then, either gas is released or weights are added until the balloon cannot raise the toy unaided by rotation of propeller 32. The size of the balloon 12, when fully inflated, should provide substantially all of the buoyancy of the flying toy, yet, with all motors "Off" the toy should rest on the ground. This equilibrium buoyancy is achieved by adding ballast to the basket, in the form of weights, preferably coins. The balancing of the weight of the toy with the buoyancy provided by the balloon requires that upon rotation of output shaft 30 and propeller 32, the flying toy will immediately rise up off of the ground. Thus, the envelope or toy balloon 12, shown in the drawings, must, when filled with lighter-than-air gas, be of sufficient size to almost lift the flying toy, yet should not be too large that the toy balloon rises off of the ground without help from the rotation of output shaft 30 and propeller 32. Thus, it should be appreciated that the lift or upward thrust provided by propeller 32 is required for the flying toy to raise up off of the ground.

When the operator desires to play with the flying toy, joystick 56 is moved from its "Off" position to an "On" position. This, by remote control, causes battery power to be provided to electric motor 28 and results in rotation of output shaft 30 with propeller 32, thereby providing an upward lift or upward thrust to the flying toy. This causes the toy to raise up off of the ground. It is preferred that the speed of rotation of output shaft 30 and propeller 32 be infinitely adjustable and precisely controlled by movement of joystick 56, such that moving joystick 56 further away from its normal "Off" position, will cause the speed of rotation of output shaft 30 and propeller 32 to correspondingly increase. Thus, the speed of ascension is controlled.

When it is desired to cause the flying toy to travel not only in a vertical line of direction but, in addition, in a first lateral direction with respect to the ground, i.e., with an angle of ascension joystick 58 is then moved from its "Off" position to provide power to electric motor 38. As previously discussed, the rotational output speed of electric motor 38 is far slower than the output of electric motors 28 and 46. The output of electric motor 38 causes axle 34 to rotate in bearing 36. Electric motor 28, output shaft 30 and propeller 32 are thus tilted. Continued rotation of propeller 32 thereby provides not only a vertical or upward thrust to the flying toy but, in addition, a lateral direction of thrust to the flying toy or an angle of ascension in a first plane passing through output shaft 30 and perpendicular to the ground. It will be appreciated that joystick 58 can be moved both forwardly and rearwardly which corresponds to tilting of electric motor 28, output shaft 30 and propeller 32 in both a forward and a rearward direction with respect to stationary electric motor 38. In this manner, the angle of ascension, defined by output shaft 30 with respect to a horizontal line, is infinitely adjustable. The toy is thus capable of assuming a plurality of positions in a vertical plane passing through outputshaft 30. By controlling the speed of electric motor 28 and the angular orientation of output shaft 30, the flying toy is truly controllable in two dimensions, i.e., in a vertical plane passing through output shaft 30.

Joystick 60, as mentioned, controls motor 46, the rotation of output shaft 48 and propeller 50 secured to output shaft 48. As desired, electric motor 46 can be energized by the battery pack 40 by movement or deflection of joystick 60 from its normal or "Off" position. If joystick 56 was in any "On" position and if joystick 58 were in its "Off" position, i.e., output shaft 30 of electric motor 28 is vertical, then movement of joystick 60 from its "Off" position to an "On" position would cause the toy balloon to rotate about a center axis passing through output shaft 30, i.e., the longitudinal center axis of the toy passing vertically therethrough. The use of the third electric motor 46, in combination with electric motors 28 and 38, gives the flying toy total three dimensional mobility in the playing environment. Either electric motor 38 can be turned to an "Off" position and electric motor 46 then energized to rotate the toy balloon or, alternatively, simultaneous control of the three motors can be used, to advantage, to provide the toy with true three-dimensional controlled mobility.

While desirable, it is really not necessary that third electric motor 46 be a variable speed reversible motor. Rather, if required for weight minimizing or cost savings, electric motor 46 can be a single output speed unidirectional motor. In the preferred embodiment of the present invention, the third electric motor 46 is of a smaller size, carrying a smaller propeller 50 than electric motor 28 and propeller 32. It is necessary only that the output shaft 48 not lie in the imaginary plane defined by the various positions achievable by the output shaft 30.

As mentioned, in the prefered embodiment of the present invention, the flying toy is remote controlled in much the same way that currently available toy cars are remote controlled. The present invention contemplates, however, that a third electric motor be provided with a third controlling joystick. If, however, in order to reduce the size of the toy balloon necessary to provide substantially all of the upward buoyancy of the toy, it is desirable to remove from the gondola or basket 18, much of the weight which is attributable to the battery pack housed therein, required for remote control, the batteries can be located proximal to the control box with electrical wiring connecting the joysticks and the electric motors located in the gondola. In this embodiment, controlling the three electric motors is carried out in the same way as in the remote control embodiment. While remote control of the flying toy is preferred in terms of "aesthetics" or desirability of playing with a flying toy, it will also be appreciated that the use of hard electrical wiring provides the flying toy with a constant tether line, so that the flying toy can always be pulled back and retrieved, if required.

It is also contemplated by the present invention that a simple magnet be secured to the basket or gondola 18, such that the gondola, when properly controlled, can be dropped down onto metal "cargo" and, subsequently, pick up and carry the same. In a preferred embodiment of this aspect of the invention, the magnet can be an electromagnet, also controlled by the batteries, with a suitable control switch such that, when and where desired, the current to the electromagnet can be turned on or off and the metal cargo can be picked up or dropped.

While the present invention contemplates that the upward lift or thrust be provided by an electric motor 28 having a first output shaft 30 defining a plane of first propeller rotation in a first horizontal plane, it will be appreciated that other mechanisms will be available for some degree of upward thrust required to overcome gravity. Other forms of upward or lateral thrust providers could be used than the illustrated electric motors rotating conventional propellers.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A flying toy controllable in three-dimensions comprising:

(a) an airborne component comprising an inflatable envelope containing a gas, said envelope having a vertical axis;

(b) a first motor secured to said envelope by a gondola suspended beneath said envelope, said first motor having a first output shaft capable of assuming a plurality of selected positions in a vertical plane and with a first propeller mounted thereon for rotation therewith, said first output shaft, when vertical, being coaxial with said vertical axis;

(c) first output shaft tilting means for selectively causing said first output shaft to achieve at least two positions in said vertical plane intersecting said vertical axis;

(d) a second motor secured to said envelope, said second motor having a second output shaft with a second propeller mounted thereon for rotation therewith, said second output shaft being tangential to an imaginery horizontal circle having a center in the line of said first output shaft, when vertical;

(e) said second motor when energized rotates said second propeller to thereby cause said envelope to rotate about said vertical axis;

(f) power supply means for energizing said first and said second motors and for activating said first output shaft tilting means; and, (g) control means for said power supply means.

2. A controllable flying toy as claimed in claim 1, wherein said first propeller is larger than said second propeller.

3. A controllable flying toy, as claimed in claim 1, wherein said first output shaft tilting means comprises a third motor secured to said envelope, said third motor having a third output shaft connected to said first motor for tilting of said first motor.

4. A controllable flying toy, as claimed in claim 1, wherein said first output shaft tilting means allows said first output shaft to achieve an infinite number of positions intersecting said vertical axis.

5. A controllable flying toy, as claimed in claim 1, wherein said envelope is also provided with pick-up means for picking up cargo.

6. A controllable flying toy, as claimed in claim 5, wherein said pick-up means is selectively capable of picking up and discharging cargo.

7. A controllable flying toy, as claimed in claim 5, wherein said pick-up means is an electromagnet connected to said power supply means.

8. A flying toy controllable in three-dimensions comprising:

(a) a helium filled balloon;

(b) a gondola suspended from said balloon and having a vertical central axis;

(c) a first motor, having a first output shaft housed in said gondola, said first output shaft being normally vertical and coaxial with said vertical central axis yet capable of selectively achieving a plurality of angular positions in a vertical plane;

(d) a first propeller secured to said first output shaft;

(e) a second motor, having a second output shaft housed in said gondola, said second output shaft, lying in a horizontal plane and tangential to a horizontal imaginery circle having a center passed through by said vertical central axis;

(f) a second propeller secured to said second output shaft;

(g) a tilting means for selectively tilting said first output shaft in said vertical plane;

(h) an electrical power supply connected to said first and said second motors; and, (i) control means for selectively supplying said electrical power supply to said first and second motor.

9. A toy as claimed in claim 8, wherein said tilting means comprises:

(a) a third motor housed in said gondola having a third output shaft connected to said first motor; and (b) said third motor being connected to said electrical power supply and also controlled by said control means.

* * * * *